US006598709B2

(12) United States Patent
Bammert

(10) Patent No.: US 6,598,709 B2
(45) Date of Patent: Jul. 29, 2003

(54) AUXILIARY DEVICE FOR DISPLACING A PAYLOAD RECEPTACLE OF AN ELEVATOR

(75) Inventor: Kurt Bammert, Luzern (CH)

(73) Assignee: Inventio AG, Hergiswil (CH)

( * ) Notice: Subject to any disclaimer, the term of this patent is extended or adjusted under 35 U.S.C. 154(b) by 72 days.

(21) Appl. No.: 09/824,165

(22) Filed: Apr. 2, 2001

(65) Prior Publication Data

US 2001/0025745 A1 Oct. 4, 2001

(30) Foreign Application Priority Data

Mar. 31, 2000 (EP) ..... 00810282

(51) Int. Cl.[7] ..... B66B 5/00; B66B 5/26
(52) U.S. Cl. ..... 187/306; 187/263; 187/377
(58) Field of Search ..... 187/263, 290, 187/298, 306, 311, 377

(56) References Cited

U.S. PATENT DOCUMENTS

| | | | | | |
|---|---|---|---|---|---|
| 3,610,371 | A | * | 10/1971 | Abbott | 187/290 |
| 4,592,450 | A | * | 6/1986 | Schaffer | 187/263 |
| 5,001,557 | A | * | 3/1991 | Begle | 187/317 |
| 5,680,911 | A | * | 10/1997 | Wang | 187/263 |
| 5,713,433 | A | * | 2/1998 | Wang | 187/263 |
| 5,878,845 | A | * | 3/1999 | Wang | 187/263 |
| 5,890,565 | A | * | 4/1999 | Wang | 187/263 |
| 5,906,252 | A | * | 5/1999 | Wang | 187/263 |
| 5,971,109 | A | * | 10/1999 | Aulanko et al. | 187/263 |
| 6,273,216 | B1 | * | 8/2001 | Kocher et al. | 187/254 |
| 6,336,523 | B1 | * | 1/2002 | Ozeki et al. | 187/277 |
| 6,427,809 | B2 | * | 8/2002 | Bammert | 187/263 |

FOREIGN PATENT DOCUMENTS

| | | | |
|---|---|---|---|
| AU | 199 950 155 | A1 | 3/2000 |
| DE | 34 46 657 | A1 | 8/1985 |
| DE | 296 15 921 | U1 | 4/1997 |
| EP | 0 947 460 | A1 | 10/1999 |
| EP | 0 990 614 | A1 | 4/2000 |
| JP | 403018576 | * | 1/1991 |
| JP | 092 78 328 | | 10/1997 |
| WO | WO 97/05051 | | 2/1997 |

* cited by examiner

*Primary Examiner*—Christopher P. Ellis
*Assistant Examiner*—Paul T. Chin
(74) *Attorney, Agent, or Firm*—Ostrolenk, Faber, Gerb & Soffen, LLP

(57) ABSTRACT

An auxiliary device for displacing a payload receptacle, which stands outside a station, into one of the stations. The auxiliary device includes a temporarily activatable brake release device for releasing the braking device and an auxiliary drive device for displacing the payload receptacle when the brake release device is activated. The brake release device and the auxiliary drive device are arranged in the uppermost region of the elevator shaft and are actuable by way of a crank rod linkage. The crank rod linkage includes a lower actuating end, which can be brought from a rest setting into a working setting. The crank rod linkage is coupled with a rod linkage extension, the vertical effective length of which corresponds with at least the vertical spacing of the walk areas of two adjacent stations.

7 Claims, 2 Drawing Sheets

AUXILIARY DEVICE FOR DISPLACING A PAYLOAD RECEPTACLE OF AN ELEVATOR

BACKGROUND OF THE INVENTION

The invention relates to an auxiliary device for displacing a payload receptacle of an elevator.

Elevators with an auxiliary device of this kind are usually used for the transport of persons or goods in a vertical direction between at least two vertically offset stations and are arranged in an elevator shaft in or at a building. The wall bounding the elevator shaft has at the level of each station a loading/unloading opening which is closable by means of a door device and at which a waiting zone adjoins, in which the payloads and/or passengers are disposed before loading or after unloading of the payload receptacle. Such an elevator essentially comprises the mentioned payload receptacle, for example a platform or a cage, a counterweight for the payload receptacle, a drive device, a braking device, at least one flexible support and drive element, i.e. a cable or rope, which runs over a drive pulley of the drive device and is connected on one side of the drive pulley with the payload receptacle and on the other side of the drive pulley with the counterweight. Moreover, the elevator possesses the required electronic power and control system. The drive device is disposed in the uppermost region of the elevator shaft above the zone thereof usable by the payload receptacle. If braking takes place in consequence of a technical problem or an emergency braking, then the load receptacle is usually not disposed in one of the stations. The auxiliary device is provided for such a case and serves the purpose of bringing the payload receptacle to one of the stations in short time, so that the persons and/or goods that are transported do not have to remain in or on the payload receptacle in the elevator shaft. The auxiliary device comprises on the one hand a temporarily activatable brake release device, by which the brake is released, and on the other hand an auxiliary device actuable, when the brake release device is activated, in order to raise or lower the payload receptacle and in order for it to brought into one of the stations or at least into a region in the station vicinity, where a risk-free unloading can take place. For elevators which are mounted in buildings with few storeys and are designed for transport of relatively small payloads, simple, manually actuable and mechanically operating brake release and auxiliary drive devices are preferably provided.

EP 0 947 460 A1 describes such an auxiliary device for an elevator for persons, with a brake release device and an auxiliary drive device. The brake release device and the auxiliary drive device are actuated by a multi-part crank rod linkage. The upper end of the crank rod linkage is its operative end. It is coupled or couplable with the brake release device and the auxiliary drive device and is disposed in the uppermost part of the elevator shaft. The lower end of the crank rod linkage is its actuating end and is provided with the requisite actuating handle elements. The crank rod linkage is pivotably constructed and mounted in such a manner that it can be pivoted out of a rest setting, in which it is disposed completely in the elevator shaft, into a working setting in which its actuating end projects through an opening of a wall bounding the elevator shaft or is actuable from such an opening. This opening is disposed in the region of the waiting area of the uppermost station of the elevator, so that the crank rod linkage can be readily actuated at its actuating end by way of the actuating handle elements by a person standing in the waiting area of this station. The obvious disadvantage of this otherwise very suitable device is to be seen in that its actuation has to take place directly below the drive region of the elevator shaft, for which purpose the opening is usually arranged at the level of the uppermost station or of the uppermost floor served by the elevator. This disadvantage is of particular significance if this station is disposed within a residential unit, as is frequently the case in superior dwellings and particularly in maisonette dwellings and penthouse dwellings.

There has become known by DE GM 296 15 921 U1 an auxiliary device which is improved with respect thereto, in which the operation of the device can take place from a location disposed at a certain distance from the uppermost station of the elevator. However, this device is of comparatively complicated construction.

SUMMARY OF THE INVENTION

It is therefore an object of the invention to provide an auxiliary device of the kind stated above which is simple with respect to construction, arrangement and operation and can be used from a location disposed at one or more floors below the uppermost station served by the elevator.

The auxiliary device according to the invention comprises, for activation of the brake release device and for actuation of the auxiliary drive device, a conventional crank rod linkage, the effective length of which is, however, enlarged in vertical direction by a rod linkage extension, which is arranged between the brake release device and the auxiliary drive device on the one hand and the conventional crank rod linkage on the other hand. Thus, the length elements of the conventional crank rod linkage are not constructed to be longer, but essentially there is used a crank rod linkage in a conventional length which bridges over a height difference of at most one floor. The rod linkage extension is connected to the upper end of this crank rod linkage. The operative end of the crank rod linkage is coupled with the lower end of the rod linkage extension, and the actuating end of the crank rod linkage can be brought from a rest setting within the elevator shaft into a working setting in which it is actuable by a person disposed outside the elevator shaft and operating the auxiliary device. For this purpose, an opening is provided in the wall of the elevator shaft.

The effective length of the rod linkage extension is selected in dependence on the vertical spacing between the operative end of the crank rod linkage and the brake release device and the auxiliary drive device.

It has proved to be favorable to construct the rod linkage extension in such a manner that it is composed of several extension elements arranged in series.

It is particularly advantageous to construct one, or optionally also several, extension elements to be resilient, i.e. as a flexible shaft. For example, this allows a resilient extension element, which is directly coupled with the brake release device and the auxiliary drive device, to arrange the downwardly following extension element at a particularly favorable position. The lowermost extension element can also be constructed resiliently, in order to arrange the crank rod linkage connected thereto at a suitable position.

In general, that extension element which has the greatest effective length in the vertical direction is constructed rigidly and mounted at a stationary location in the elevator shaft.

The operative end of the actual crank rod linkage is then coupled with the lowermost extension element of the rod linkage extension. The coupling takes place at a coupling location about which the crank rod linkage is thus pivotable out of its rest position.

By markings supplied at appropriate spacings to the flexible support and drive element it can be detected, by a view through the opening, when the payload receptacle has reached the exact height position of a station.

Preferably, the auxiliary device also comprises an image transmission device, with a sensor for detection of images of the uppermost region of the elevator shaft, with a display device for visualization of these images in the region of the opening and with the transfer path for connecting the sensor with the display device for the purpose of transmission of the images.

So that, in a given case, a user of the elevator who is located in a elevator standing outside a station, can himself or herself actuate the brake release device and the auxiliary drive device and thereby release himself or herself, there is additionally provided by means of a flexible shaft a connection between the brake release device and the auxiliary drive device on the one hand and an auxiliary crank rod linkage on the other hand, which can be used from the blocked payload receptacle or cage. The end of the auxiliary crank rod linkage to be actuated from the payload receptacle can be arranged behind a door or a flap, the locking mechanism of which is preferably provided with a lead seal for avoidance of misuse of the auxiliary crank rod linkage. Moreover, the above-mentioned image transmission device can comprise an auxiliary display device, which is viewable from the payload receptacle.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred

DETAILED DESCRIPTION OF THE PREFERRED EMBODIMENTS

Figure 1:
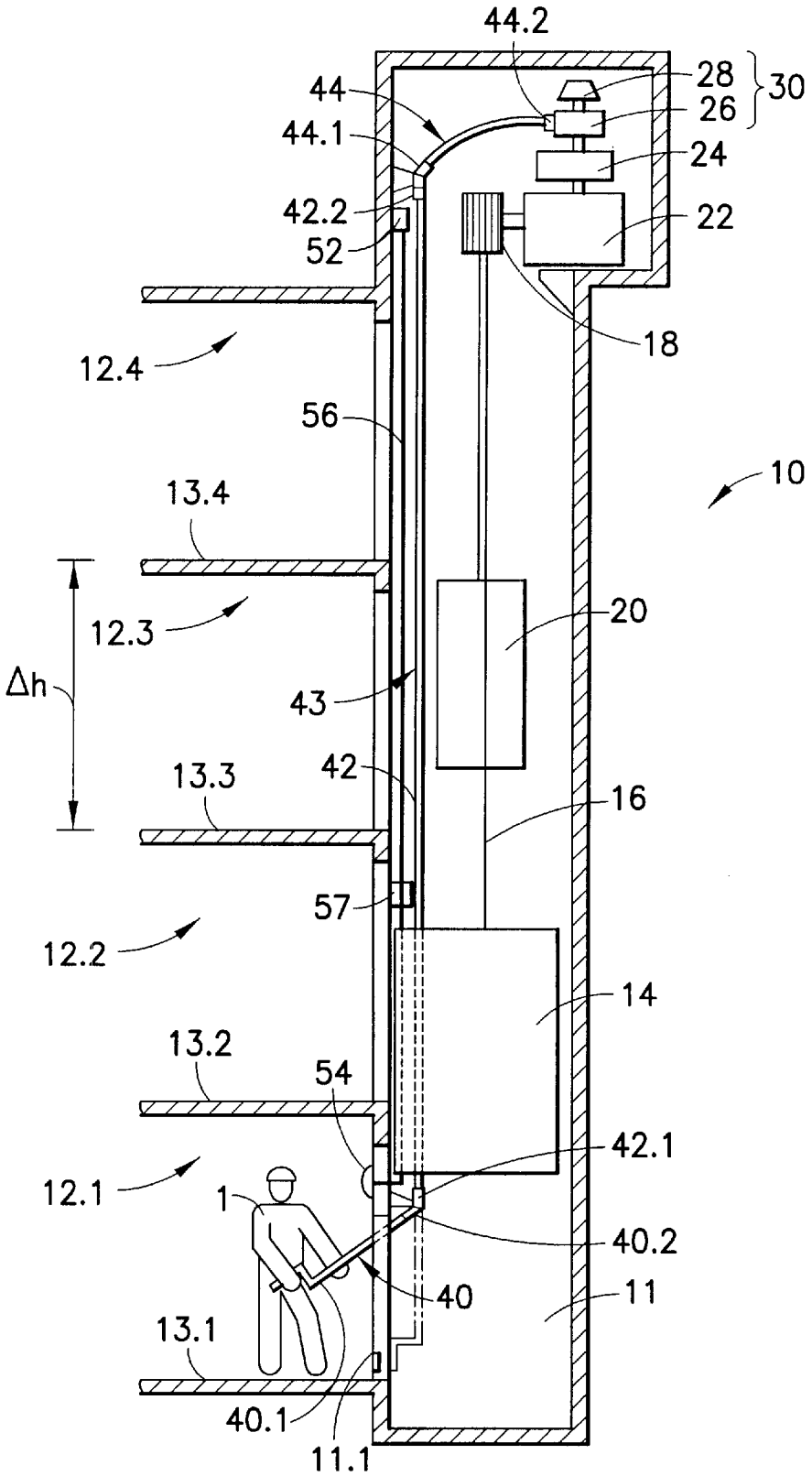
FIG. 1 shows a first elevator with an auxiliary device according to the invention, seen from the side.

The elevator 10 illustrated in FIG. 1 is arranged in an elevator shaft 11 and serves several stations 12.1, 12.2, 12.3 and 12.4 in floors arranged one above the other. The elevator shaft 11 has in each of the floors a door opening which is closed by means of a door, which is not illustrated. The door of a station can be opened only when a payload receptacle 14 of the elevator 10 lies at rest in this station. Disposed in each floor in front of the doors are waiting areas, the pedestrian floor surfaces of which are denoted by 13.1, 13.2, 13.3 and 13.4. The spacing between two pedestrian floor surfaces of two adjacent floors is denoted as vertical spacing $\Delta h$ of two adjacent floors. The payload receptacle 14 mentioned further above, which here is constructed as a cage, is blocked in the elevator shaft 11 between the stations 12.1 and 12.2. The payload receptacle 14 is fastened to one end of a flexible support and drive element 16. Starting from the payload receptacle 14, the flexible support and drive element 16 runs upwardly to a drive pulley 18 in the uppermost region of the elevator shaft 11, runs around this drive pulley 18 and runs back down to a counterweight 20 of the payload receptacle 14. A drive device 22 serves for drive of the drive pulley 18. A braking device 24 is disposed in the uppermost region of the elevator shaft 11. Moreover, disposed in the uppermost region of the elevator shaft 11 are a temporarily activatable brake release device 26 and an auxiliary drive device 28 for the drive pulley 18. The brake release device 26 and the auxiliary drive device 28 are components of an auxiliary device 30, which serves the purpose of displacing the payload receptacle 14 when in consequence of technical problems it is blocked by the braking device 24 between two of the stations 12.1 to 12.4. For displacement of the blocked payload receptacle 14 into a station the brake release device 26 is activated by an operative 1 in the waiting area of the station 12.1 and the auxiliary drive device 28 is actuated during the activation of the brake release device 26. The drive pulley 18 rotates under the action of the auxiliary drive device 28, whereby the flexible support and drive element 16 is set into motion with the consequence that the payload receptacle 14 is, in accordance with the rotational direction of the drive pulley 18, raised or, as is generally the case, lowered. The operative 1 can in this case be located in the waiting area of one of the stations 12.1 to 12.3, but in any event below the uppermost station 12.4 served by the elevator 10. In the illustrated embodiment the payload receptacle 14, as already explained, is blocked between the stations 12.1 and 12.2 and shall be brought, by means of the auxiliary drive device, into the station 12.1 where its position is indicated by 14' in FIG. 2.

Serving for actuation of the brake release device 26 and the auxiliary drive device 28 is a crank rod linkage 40, which is prolonged at the top by a rod linkage extension 43, which in turn comprises a lower extension element 42 and an upper extension element 44. The crank rod linkage 40 is, in its rest setting, completely received in the elevator shaft 11, while in its working setting according to FIG. 1 it is so pivoted that at least its lower end 40.1, which is also denoted as actuating end 40.1, projects through a window opening 11.1 in the wall of the elevator shaft 11 and out of the shaft. The upper end 40.2 of the coupling rod 40, which is also denoted as operative end 40.2, is coupled with the lower end 42.1 of the lower extension element 42. This lower extension element 42 is constructed to be rigid and mounted in stationary location in the elevator shaft 11. The upper end 42.2 of the lower, rigid extension element 42 is coupled with the lower end 44.1 of the upper extension element 44. The upper extension element 44 is flexible or constructed in the manner of a flexible shaft. The upper end 44.2 of this flexible, upper extension element 44 of the rod linkage extension 43 is finally coupled with the brake release device 26 and the auxiliary drive device 28.

The rod linkage extension 43 enables, as envisaged, the actuating end 40.1 of the crank rod linkage 40 to be arranged one or several floors below the uppermost floor served by the elevator. In the present embodiment the elevator 10 serves the four stations 12.1 to 12.4, wherein 12.4 is the uppermost station and the operation of the auxiliary device or the actuation of the crank rod linkage 40 is provided from the waiting area of the station 12.1. The auxiliary device 30 can therefore, as intended, be actuated from a fixed location outside a penthouse with internal elevator access. The possibility exists of so constructing the rod linkage extension 43 that the auxiliary device 30 can even be actuated at a greater distance, i.e. in the extreme case from the basement floor, as illustrated in FIG. 1.

The exact position of the payload receptacle can be visibly marked by appropriate markings of the flexible support and drive element 16.

If, in particular, the auxiliary device 30 is actuated at a great vertical distance from the drive device it is advantageous to supplement the afore-described components of the auxiliary device 30 by an image transmission device so that the operative 1 is given the possibility of observing the movement of the drive pulley 18 or even the drive pulley 18 itself and even when no visual contact exists. For this purpose a sensor 52 for detection of images, particularly of the drive pulley 18, is arranged in the region of the drive pulley 18, and a display device 54 for visualization of these images is arranged in the region of the waiting area of the station 12.1. The sensor 52 and the display device 54 are connected by a suitable transfer path 56 for transmission of the images detected by the sensor 52, which images are visualised on the display device 54. Since energy is usually needed for this image transmission device, but the blocking of the payload receptacle 14 is frequently due to a failure of the energy supply, an emergency current unit 57 for the image transmission device is provided.

Figure 2:
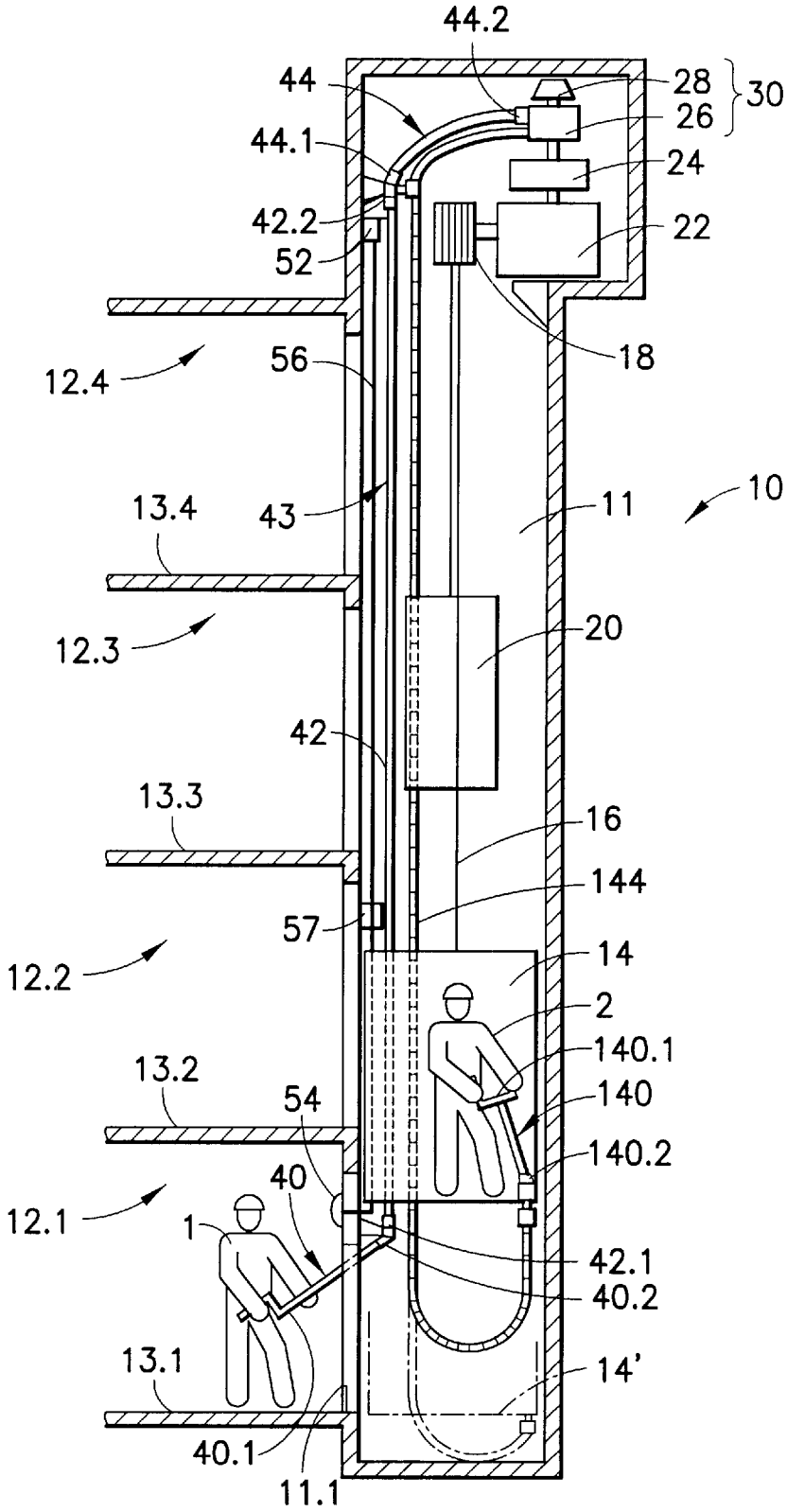
FIG. 2 shows a second elevator with an auxiliary device according to the invention, which is actuable from the payload receptacle, in the same illustration as FIG. 1.

FIG. 2 shows an elevator 10 with an auxiliary device 30 according to the invention which is constructed substantially the same and is provided with the same reference numerals as the elevator according to FIG. 1, but which additionally has an auxiliary crank rod linkage 140, the actuating end 140.1 of which is accessible or actuable in case of need from the payload receptacle 14. This auxiliary crank rod linkage 140 is directly or indirectly coupled with the brake release device 26 and the auxiliary drive device 28 by way of a flexible rod linkage extension 144 coupled to the lower end 140.2 of the auxiliary crank rod linkage 140.

The invention is suitable for elevators without an engine room. To be understood by this are elevators which do not have an own engine room. The drives thereof are thus disposed in the elevator shaft near the counterweight and the elevator cage.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. An auxiliary device for displacing a payload receptacle of an elevator which stands in an elevator shaft outside a station, the elevator including a braking device, the auxiliary device comprising:

a temporarily activatable brake release device operative to release the braking device;

an auxiliary drive device operative to displace the payload receptacle when the brake release device is activated, the brake release device and the auxiliary drive device being arrangable in an uppermost region of the elevator shaft;

a crank rod linkage connected to the brake release device and the auxiliary drive device, the crank rod linkage having an actuating end movable from a rest position within one of the elevator shaft and a wall of the elevator shaft through an opening in the wall of the elevator shaft into a working position outside the elevator shaft; and a rod linkage extension coupled with the crank rod linkage, the rod linkage extension having a vertically effective length that substantially corresponds to at least a vertical spacing of pedestrian floor areas of two adjacent stations, the rod linkage extension comprising several extension elements arranged and coupled in series, one of the extension elements has a greatest vertical effective length of the extension elements and is rigid and mounted at a stationary location in the elevator shaft.

2. An auxiliary device according to claim 1, wherein one of the extension elements of the rod linkage extension is resiliently constructed as a flexible shaft.

3. An auxiliary device according to claim 2, wherein the flexible shaft is coupled directly with the brake release device and the auxiliary drive device.

4. An auxiliary device according to claim 1, and further comprising an image transmission device which comprises a sensor for detection of images of the uppermost region of the elevator shaft, a display device for displaying these images in a region of the opening and a transfer path for connecting the sensor with the display device for transmission of the images.

5. An auxiliary device according to claim 4, wherein the images show markings of a flexible support and drive element.

6. An auxiliary device according to claim 1, and further comprising an additional crank rod linkage arranged to be actuable from the payload receptacle, and a flexible rod linkage extension connected to the additional crank rod linkage and coupled with the brake release device and the auxiliary drive device.

7. An elevator installation, comprising:

an elevator shaft having a plurality of vertically aligned stations with respective pedestrian floor areas;

a payload receptacle arranged in the elevator shaft so as to be vertically movable;

means for braking the payload receptacle in the elevator shaft;

means for temporarily releasing the braking means;

auxiliary drive means for displacing the payload receptacle when the brake release means is activated, the brake release means and the auxiliary drive means being arranged in an uppermost region of the elevator shaft;

a crank rod linkage connected to the brake release means and the auxiliary drive means for driving the auxiliary drive means, the crank rod linkage having an actuating end arranged to be movable from a rest position within one of the elevator shaft and a wall of the elevator shaft through an opening in the wall of the elevator shaft into a working position outside the elevator shaft; and a rod linkage extension coupled with the crank rod linkage, the rod linkage extension having a vertical effective length that substantially corresponds to at least a vertical spacing of the pedestrian floor areas of two adjacent station in the elevator shaft, the rod linkage extension comprising several extension elements arranged and coupled in series, one of the extension elements has a greatest vertical effective length of the extension elements and is rigid and mounted at a stationary location in the elevator shaft.

* * * * *